US006706006B2

(12) United States Patent
Kostrov et al.

(10) Patent No.: US 6,706,006 B2
(45) Date of Patent: Mar. 16, 2004

(54) METHOD AND APPARATUS FOR CAVITATION VIBRO-SUCTION MASSAGE

(76) Inventors: Sergey A. Kostrov, 5945 W. Parker Rd., Apartment 1731, Plano, TX (US) 75093; Olga Zakharova, 5945 W. Parker Rd., Apartment 1731, Plano, TX (US) 75093; Esther Wooden, 5928 Henley Dr., Plano, TX (US) 75093; William O. Wooden, 5928 Henley Dr., Plano, TX (US) 75093

( * ) Notice: Subject to any disclaimer, the term of this patent is extended or adjusted under 35 U.S.C. 154(b) by 29 days.

(21) Appl. No.: 10/056,011

(22) Filed: Jan. 28, 2002

(65) Prior Publication Data

US 2003/0144612 A1 Jul. 31, 2003

(51) Int. Cl.[7] ..... A61H 9/00; A61H 23/04

(52) U.S. Cl. ..... 601/9; 601/10; 601/55; 601/47

(58) Field of Search ..... 601/156, 157, 601/158, 159, 160, 169, 167, 154, 6, 9, 10, 55, 47

(56) References Cited

U.S. PATENT DOCUMENTS 2,232,218 A * 2/1941 Doty ..... 601/12
3,067,739 A * 12/1962 Karlik ..... 601/160
4,220,145 A * 9/1980 Stamp et al. ..... 601/169
4,441,488 A * 4/1984 Macabee ..... 601/160
4,458,676 A * 7/1984 Pileggi ..... 601/105
4,640,462 A * 2/1987 Stearns, III ..... 601/160
5,070,864 A * 12/1991 Lemons ..... 601/160
6,196,982 B1 * 3/2001 Ball ..... 60/6
6,306,110 B1 * 10/2001 McElhannon ..... 601/160

FOREIGN PATENT DOCUMENTS

JP 2003-38382 * 2/2003

* cited by examiner

*Primary Examiner*—Danton D. DeMille

(57) ABSTRACT

A hand held hydro-suction vibration bio-stimulator submerged below the surface of a liquid in the liquid filled vessel and connected to a fluid supply by means of a flexible hose to create a periodical suction force in the range of 0.5–70 N on the frequency of 10–200 Hz and high frequency vibrations in the range of 1–20 kHz to the skin of the human body both being submerged under the surface of a liquid in a liquid filled vessel due to the passing of the fluid from the fluid supply through the hydro-suction vibration bio-stimulator.

8 Claims, 1 Drawing Sheet

METHOD AND APPARATUS FOR CAVITATION VIBRO-SUCTION MASSAGE

TECHNICAL FIELD

The present invention relates in general to therapeutic devices and methods such as massage devices that couple acoustic energy and suction action to stimulate specific areas of living organisms for the purposes of massage and reduction of cellulite fat.

BACKGROUND OF INVENTION

Many different techniques and apparatus are known in prior art for massage using flowing water. Some, made by various manufacturers, that are marketed through plumbing and hardware stores are capable of discharging water streams for impacting and massaging the human body. For instance U.S. Pat. Nos. 4,689,839 and 4,726,080 describe a tap water powered hydrotherapy apparatus in which a water stream is discharged from a discharge orifice into a tub below the water surface and energy derived from the supplied tap water causes the discharge orifice to move along a travel path.

U.S. Pat. No. 5,230,106 discloses a hand-held tap water-powered water discharge apparatus that can operate in submerged hydro-massage mode. The preferred apparatus described wherein includes a sealed housing preferably configured to be held in a user's hand and mounted on the free end of a flexible tap water supply hose. A jet pump is mounted in the housing that, in hydro-massage mode, uses the supplied water to entrain tub water.

A related apparatus is described in U.S. Pat. No. 5,197,459 wherein an electric pump-powered submersible hand-held apparatus for discharging of a water stream for massaging the human body. The apparatus includes a hand-held housing mounted on the free end of a flexible hose. An electric pump draws in tub water and supplies it under the pressure necessary for flow through the hose, to the nozzle that discharges a water jet.

All above-mentioned apparatuses generate pulsing water flow streams for massaging the human body. Their disadvantage is that they do not generate the vibrations affecting the body's skin. In other words, the skin does not undergo the periodical tension stresses that are beneficial for dispersing of the cellulite fat under the body's skin and relaxation of muscles during the massaging.

SUMMARY OF THE INVENTION

Accordingly, a primary object of the present invention is to provide a method and apparatus for dispersing of the cellulite fat under the body's skin and relaxation of muscles during the massaging which includes a fluid supply connected by means of the supply hose to the inlet of a valve for the control of the fluid flow-rate and pressure. The outlet of the valve by means of the flexible hose is connected to a hydro-suction vibration bio-stimulator. The hydro-suction vibration bio-stimulator has a hollow cavitation suction chamber having at least one inlet tangential to the axis of symmetry of said hollow cavitational suction chamber allowing the passage of the fluid from a fluid supply into the said hollow cavitational suction chamber of the hydro-suction vibration bio-stimulator and at least one outlet for discharging the fluid flowing through the hydro-suction vibration bio-stimulator thereby generating the periodical low frequency suctions and high frequency vibrations on the surface of the human skin due to the flow of fluid through the hydro-suction vibration bio-stimulator.

It is another object of present invention to provide an apparatus for dispersing of the cellulite fat under the body's skin and relaxation of muscles during the massaging in which the hollow cavitational suction chamber of hydro-suction vibration bio-stimulator has a cylindrical shape having the cross-sectional square area 3 to 16 times more than the cross-sectional square area of inlet the hydro-suction vibration bio-stimulator.

It is another object of present invention to provide an apparatus for dispersing of the cellulite fat under the body's skin and relaxation of muscles during the massaging in which the hollow cavitational suction chamber of hydro-suction vibration bio-stimulator has a spherical shape having the cross-sectional square area at the symmetry center of the sphere 2.5 to 16 times more than the cross-sectional square area of inlet of the hydro-suction vibration bio-stimulator.

It is another object of present invention to provide an apparatus for dispersing of the cellulite fat under the body's skin and relaxation of muscles during the massaging in which at least one pin is installed on the bottom of the hollow cavitational suction chamber the hydro-suction vibration bio-stimulator.

It is another object of present invention to provide an apparatus for dispersing of the cellulite fat under the body's skin and relaxation of muscles during the massaging in which at least one roller is installed on the bottom of the hollow cavitational suction chamber of the hydro-suction vibration bio-stimulator.

It is further object of present invention to provide a method for dispersing of the cellulite fat under the body's skin and relaxation of muscles during the massaging session comprising the steps of providing a fluid supply connected by means of a supply hose to the control flow rate and pressure valve which in turn is connected by means of the flexible hose to the hydro-suction vibration bio-stimulator applied to the massaging part of user's body submerged under the surface of liquid in said liquid-filled vessel and supplying the 2–10 gpm flow rate of the fluid through the hydro-suction vibration bio-stimulator thereby generating the periodical suction force in the range of 0.5–70 N on the frequency of 10–200 Hz and high frequency vibrations in the bandwidth of 1–20 kHz.

It is another object of present invention to provide a method for dispersing of the cellulite fat under the body's skin and relaxation of muscles during the massaging in which the amplitude of the suction pressure $P_s$ of periodical suction force is defined by the formulae:

$$P_s = \frac{\rho Q^2}{10.5 S_{in}^2},$$

wherein ρ is a liquid density, Q is the flow rate of fluid through the hydro-suction vibration bio-stimulator and $S_{in}$ is the cross-sectional square area of at least one inlet of the hydro-suction vibration bio-stimulator.

BRIEF DESCRIPTION OF THE DRAWINGS

Other objects and advantages of the invention will become apparent from the study of the following specification when viewed in light of the accompanying drawings, in which.

DETAILED DESCRIPTION OF EMBODIMENT

Figure 1:
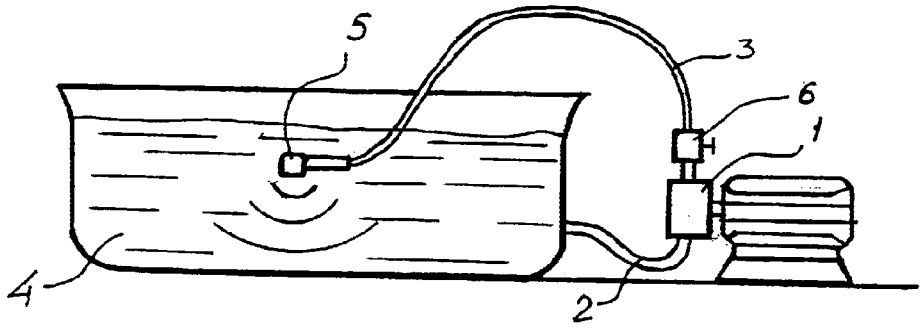
FIG. 1 is a cross-sectional side view of the fluid-filled vessel showing details of assembly, according the invention.

Referring to FIG. 1, a device for dispersing of the cellulite fat under the body's skin and relaxation of muscles during the massaging is shown. Device includes a liquid-filled vessel 4, hose 2 attached to a fluid supply as for example to the inlet of pump 1 and connected to the liquid-filled vessel 4. The outlet of the pump 1 is connected to the hydro-suction vibration bio-stimulator 5 by means of a flexible outlet hose 3. The control valve 6 is installed on the outlet hose 3 for changing of the fluid flow-rate and pressure through the hydro-suction vibration bio-stimulator 5.

Figure 2:
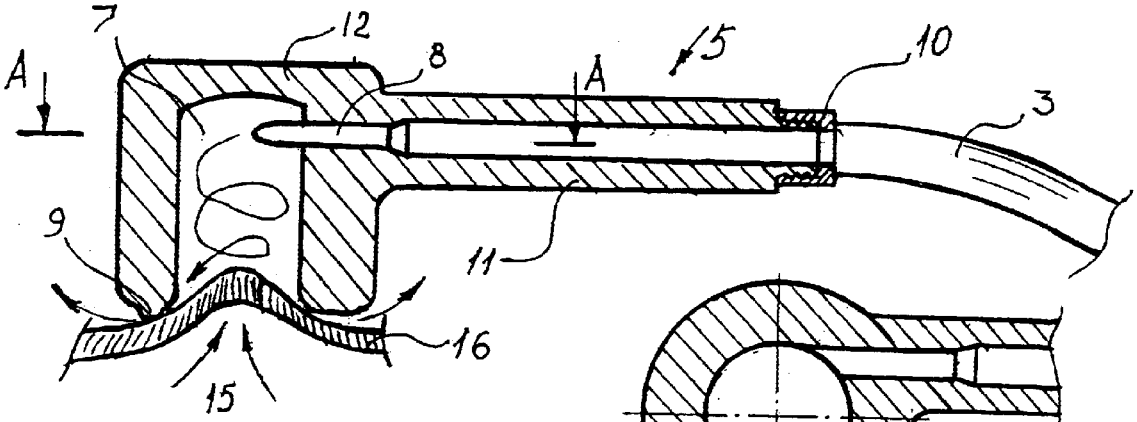
FIG. 2 is a cross-sectional view of the hydro-suction vibration bio-stimulator with tangential inlet.
Figure 2A:
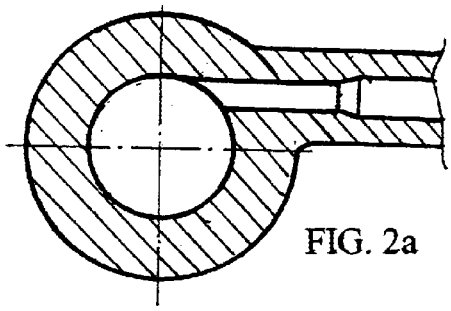
FIG. 2*a* is a cross-sectional view of FIG. 2 taken along line A—A.

Referring to FIG. 2, the hydro-suction vibration bio-stimulator 5 is connected to the flexible outlet hose 3 by means of thread connection 10 or any other sealed connection and consist of a handle 11 having an internal passage for supplying a fluid to the tangential inlet 8 (FIG. 2*a*) and further to the hollow cavitational suction chamber 7 for creating cavitation bubbles inside the hollow cavitational suction chamber 7 and periodical suction force in the vicinity of the outlet 15 thereby sucking the body skin 16 into the hollow cavitational suction chamber 7 and generating high frequency vibrations due to the collapse of cavitation bubbles in the vicinity of the surface of the skin 16. The pins 9 are attached to the bottom of the hollow cavitational suction chamber 7.

Figure 3:
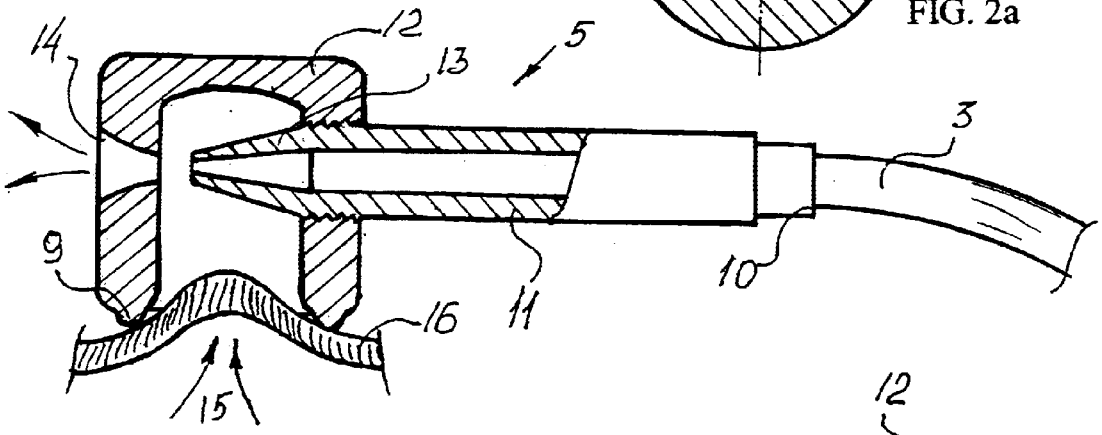
FIG. 3 is a cross-sectional view of the hydro-suction vibration bio-stimulator with non-tangential inlet.

Referring to FIG. 3, the hydro-suction vibration bio-stimulator 5 includes a nozzle 13 and additional outlet 14 for creating of a suction force in the vicinity of the outlet 15. As shown on FIG. 4, the pin 9 can be made as a roller 17.

For dispersing of the cellulite fat under the body's skin and relaxation of muscles during the massaging the hydro-suction vibration bio-stimulator 5 (FIG. 1) is installed under the surface of a liquid in a liquid filled vessel 4. The hydro-suction vibration bio-stimulator 5 is connected to a fluid supply or for example to the pump 1 by means of outlet hose 3. The control valve 6 is used for changing of the fluid flow and pressure rate through the hydro-suction vibration bio-stimulator 5. The hose 2 connected between the pump 1 and vessel 4 serves as a means to provide fluid flow through the hydro-suction vibration bio-stimulator 5.

The fluid undergoes a rotational motion inside the hollow cavitational suction chamber 7 (FIG. 2) as far as the fluid enters into the hollow cavitational suction chamber 7 through the at least one inlet 8 due to the fact that inlet 8 is a tangential one relatively the axis of symmetry of the hollow cavitational suction chamber 7 inside the massager head 12. The rotational motion of the fluid causes the decrease of pressure and, as a consequence, the appearance of a cavitation bubbles on the axis of the hollow cavitational suction chamber 7 and, as a result, a suction force in the vicinity of the outlet 15 thereby creating a suction of the body skin 16 into the hollow cavitational suction chamber 7. But such action leads to the temporary closing of the outlet 15 and that, in turn, leads to the increase of a pressure inside the hollow cavitational suction chamber 7 due to the fluid flow through inlet 8 thereby temporarily eliminating of suction force. Under such conditions the body skin 16 returns to the previous place for a moment and again undergoes next suction action due to the above mentioned causes and the process repeats itself. That auto-oscillation process of the suction occurrences has a frequency depending on the actual decrease of pressure inside the hollow cavitational suction chamber 7 and the size of pins 9 and accounts for 10–200 Hz. There are also high frequency vibrations inside the hollow cavitational suction chamber 7 due to the multiple collapses of the cavitation bubbles. The decrease of pressure is described by the formulae:

$$P_s = \frac{\rho Q^2}{10.5 S_{in}^2},$$

wherein ρ is a liquid density, Q is the flow rate of fluid through the hydro-suction vibration bio-stimulator 5 and $S_{in}$ is the cross-sectional area of at least one inlet 8 of the hydro-suction vibration bio-stimulator 5. For example, the decrease of pressure for parameters equaled $S_{in}=4.06\times10^{-3}$ m, p=1000 kg/m$^3$ and $Q=3.15\times10^{-4}$ m$^3$/sec (or 5 gpm) will be 57.3 kPa (8.2 psi.) The suction force affecting on the body skin in the vicinity of the outlet 15 is determined by the following formulae:

$$F_s=P_s S_{out},$$

wherein $S_{out}$ is the cross-sectional square area of outlet 15. For above noted example and $S_{out}=9.6\times10^{-4}$ m$^2$ the suction force $F_s$accounts for 54 N or 12 lbf.

FIG. 3 illustrates the hydro-suction vibration bio-stimulator 5 in accordance with the present invention which is similar to the one depicted in FIG. 2 except that it includes non-tangential nozzle 13 and additional outlet 14 for creating of a suction force in the vicinity of the outlet 15.

Figure 4:
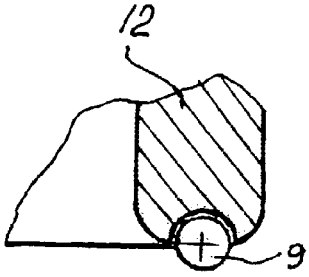
FIG. 4 is a view of roller installed on the bottom of the hydro-suction vibration bio-stimulator.

FIG. 4 illustrates the hydro-suction vibration bio-stimulator 5 in accordance with the present invention which is similar to the one depicted in FIG. 2 except that it includes at least one roller 17 allowing to reduce the friction factor between the skin and the hydro-suction vibration bio-stimulator 5 during the movement of the hydro-suction vibration bio-stimulator 5 in case of massage for the delicate areas of skin, for example, the face. Roller 17 can be made as a ball installed inside the hollow semi-sphere as shown on FIG. 4.

Besides the dispersing of the cellulite fat under the body's skin and relaxation of muscles during the massaging session as was reported, for instance, in the article ("Noninvasive Mechanical Body Contouring: A Preliminary Clinical Outcome Study". J. Aesthetic Plastic Surgery. V. 21, p. 61–67, 1997) written by Robert A. Ersek, et al. the present invention can be use for treating skeletal conditions such as osteoporosis as was reported in the article ("Anabolism: Low Mechanical Signals Strengthen Long Bones." Nature, Vo. 412, p. 603–604, 2001) written by Clinton Rubin, et el. and also for acceleration of the healing process of the broken bones as was reported in the article ("The Use of Low-Intensity Ultrasound to Accelerate the Healing of Fractures. "The Journal of Bone and Joint Surgery, V. 83-A, No. 2, p. 259–270, 2001) written by Clinton Rubin, et al.

While in accordance with the provisions of the Patent Statutes the preferred forms and the embodiments of the invention have been illustrated and described, it will be apparent to those of ordinary skill in the art various changes and modifications may be made without deviating from the inventive concepts set forth above.

Having described the invention we claim:

1. Apparatus for dispersing of the cellulite fat under the body's skin and relaxation of muscles during the massage comprising:

a) a hydro-suction vibration bio-stimulator connected to a fluid supply by means of a flexible hose and said hydro-suction vibration bio-stimulator includes a hollow cavitational suction chamber having at least one inlet tangential to the axis of symmetry of said hollow cavitational suction chamber allowing the passage of fluid from said fluid supply into said hollow cavitational suction chamber for creating cavitation bubbles and having at least one outlet for discharging said fluid containing said cavitation bubbles to the surface of the human skin and generating periodical suction force and vibrations.

2. Apparatus as defined in claim 1, wherein a control valve for changing of the flow rate and pressure of said fluid is arranged between said fluid supply and said hydro-suction vibration bio-stimulator.

3. Apparatus as defined in claim 1, wherein said hollow cavitational suction chamber of said hydro-suction vibration bio-stimulator has a cylindrical shape having the cross-sectional area 3 to 16 times more than the cross-sectional area of said inlet of said hydro-suction vibration bio-stimulator.

4. Apparatus as defined in claim 1, wherein said hollow cavitational suction chamber of said hydro-suction vibration bio-stimulator has a spherical shape having the cross-sectional square area at the symmetry center of the sphere 2.5 to 16 times more than the cross-sectional square area of said inlet of said hydro-suction vibration bio-stimulator.

5. Apparatus as defined in claim 1, wherein at least one pin is installed on the bottom of said hollow cavitational suction chamber.

6. Apparatus as defined in claim 1, wherein at least one roller is installed on the bottom of said hollow cavitational suction chamber.

7. A method for dispersing cellulite fat under the body's skin and relaxation of muscles during the massage, comprising the steps of:

a) providing a liquid filled vessel;

b) providing a a fluid supply;

c) providing a hydro-suction vibration bio-stimulator;

d) providing a control valve;

e) connecting said fluid supply to the inlet of said control valve by means of a hose;

f) connecting the outlet of said control valve to said hydro-suction vibration bio-stimulator by means of a flexible hose;

g) applying said hydro-suction vibration bio-stimulator on the skin of human body below the surface of liquid in said liquid filled vessel;

h) providing fluid flow through said hydro-suction vibration bio-stimulator with the flow rate in the range of 2–10 gpm and generating the periodical suction force in the range of 0.5–70 N on the frequency of 10–200 Hz and high frequency vibrations in the range of 1–20 kHz.

8. A method as defined in claim 7, wherein the amplitude of the suction pressure $P_s$ of said periodical suction force is defined by the formulae:

$$P_s = \frac{\rho Q^2}{10.5 S_{in}^2},$$

wherein ρ is a liquid density, Q is a flow rate of said fluid through said hydro-suction vibration bio-stimulator and $S_{in}$ is said cross-sectional area of at least one inlet of the hydro-suction vibration bio-stimulator.

* * * * *